US007532186B2

(12) United States Patent
Tsai et al.

(10) Patent No.: US 7,532,186 B2
(45) Date of Patent: May 12, 2009

(54) LIQUID CRYSTAL DISPLAY DRIVING APPARATUS AND METHOD THEREOF

(75) Inventors: Chung-Kuang Tsai, Jhudong Township, Hsinchu County (TW); Li-Ru Lyu, Jhubei (TW)

(73) Assignee: AU Optronics Corp., Hsinchu (TW)

( * ) Notice: Subject to any disclaimer, the term of this patent is extended or adjusted under 35 U.S.C. 154(b) by 724 days.

(21) Appl. No.: 10/848,234

(22) Filed: May 19, 2004

(65) Prior Publication Data

US 2004/0246224 A1 Dec. 9, 2004

(30) Foreign Application Priority Data

May 22, 2003 (TW) ..... 92113907 A
Apr. 27, 2004 (TW) ..... 93111798 A

(51) Int. Cl.
*G09G 3/36* (2006.01)

(52) U.S. Cl. ..... 345/89; 345/87; 345/690

(58) Field of Classification Search ..... 345/89, 345/87, 690, 691; 349/33, 173
See application file for complete search history.

(56) References Cited

U.S. PATENT DOCUMENTS 6,784,898 B2 8/2004 Lee et al.
7,084,845 B2 * 8/2006 Hong ..... 345/89
2002/0044115 A1 4/2002 Jinda et al.
2002/0109654 A1 8/2002 Kwon
2003/0006952 A1 1/2003 Hong
2003/0048246 A1 3/2003 Ham
2003/0048247 A1 3/2003 Ham
2003/0179175 A1 * 9/2003 Shigeta et al. ..... 345/101

FOREIGN PATENT DOCUMENTS

EP 1 122711 8/2001
JP 3-251818 11/1991
JP 2002-108294 4/2002
JP 2002-116743 4/2002

* cited by examiner

*Primary Examiner*—Sumati Lefkowitz
*Assistant Examiner*—Seokyun Moon
(74) *Attorney, Agent, or Firm*—Rabin & Berdo, P.C.

(57) ABSTRACT

A liquid crystal display (LCD) driving apparatus and the method thereof is disclosed. The method receives a pixel and drives a pixel of the LCD according to the pixel value During a frame period, wherein the frame period is divided into a precharge field and a compensation field. Firstly, a precharge pixel value is decided according to the pixel and a reference value. A compensation pixel value is decided according to the precharge pixel. Next, a precharge driving voltage is determined according to the precharge pixel value. Afterwards, a compensation driving voltage is determined according to the compensation pixel value. Finally, the pixel is driven according to the precharge driving voltage and the compensation driving voltage respectively during the precharge field and the compensation field.

5 Claims, 17 Drawing Sheets

| input | output | |
|---|---|---|
| pixel value | precharge pixel value | compensation pixel value |
| 0 | 0 | 0 |
| 1 | 0 | 0 |
| 2 | 0 | 1 |
| 3 | 0 | 3 |
| 4 | 0 | 9 |
| ... | ... | ... |
| ... | ... | ... |
| 251 | 250 | 255 |
| 252 | 252 | 255 |
| 253 | 253 | 255 |
| 254 | 254 | 255 |
| 255 | 255 | 255 |

FIG. 16B

LIQUID CRYSTAL DISPLAY DRIVING APPARATUS AND METHOD THEREOF

This application claims the benefit of Taiwan applications, Serial No. 092113907, filed May 22, 2003, and Serial No. 093111798, filed Apr. 27, 2004, the subject matter of which is incorporated herein by reference.

BACKGROUND OF THE INVENTION

1. Field of the Invention

The invention relates in general to a liquid crystal display (LCD) driving apparatus and the method thereof, and in particular to an LCD driving apparatus and the method thereof having improved displaying quality.

2. Description of the Related Art

Liquid crystal displays (LCDs) have been widely used for their characteristics of lightness and thinness. However, the LCDs have slow speed of responding, as compared with the traditional cathode ray tube (CRT) monitor. The LCD tends to have image residue as the dynamic images are displayed, while the CRT monitor does not.

The way that the CRT monitor displays the frames is called an impulse type. Each pixel only emits light at an instant during each frame period. Referring to FIG. 1, it shows the relation of lightness l for one pixel vs. time t of the CRT monitor. The pixel values D of this pixel at frame period T1, T2, and T3 are supposed to be respectively 34, 100, and 30. The illumination intensities of pluses 11 are controlled according to the pixel values D. The lightness of the present frame period will not affect that of the next frame period as a consequence of the impulse type, and thus the image residue is not existed and the response time is short.

The way that the LCD displays the frames is called a hold type. Each pixel value D emits constant light in one frame period. Referring to FIG. 2A, it shows the relation of time t and driving voltage Vd applied to the pixel according to the display of LCD. The pixel values D of the pixel at frame periods T1, T2, and T3 are supposed to be respectively 34, 100, and 30. The driving voltages Vd at frame period T1, T2, and T3 are respectively determined according to those pixel values D.

Referring to FIG. 2B, it shows the diagram of the lightness L of the pixel vs. time t. The lightness line 21 is the ideal lightness of the pixel according to the driving voltage Vd of FIG. 2A. In reality, the response speed of the liquid crystal molecule is slower than that of the electric field, and thus a response time is required for the pixel to reach the proposed lightness. The lightness line 22 is the actual lightness of the pixel according to the driving voltage Vd of FIG. 2A. The quality of image is lowered with the image residue caused by the slow response.

The above problem can be improved, for example, by over-driving method. If the pixel value of the present frame period to be displayed is larger than that of the previous one, the driving voltage larger than that to be displayed is applied to the pixel. If the pixel value of the present frame period to be displayed is smaller than that of the previous one, the driving voltage smaller than that to be displayed is applied to the pixel.

However, the display quality of LCD is still not as satisfying as the CRT even if the liquid crystal molecule responds to the applied driving voltage in real time due to the hold type. For example, the image at the beginning of the frame period T3 will overlaps with the image of the frame period T2 by human's eye, when the responding is supposed to be real time according to the lightness lines 21 of FIG. 2B. Therefore, not only the low speed of responding, but the hold type also decreases the displaying quality of the LCD.

SUMMARY OF THE INVENTION

It is therefore an object of the invention to provide a liquid crystal display (LCD) driving apparatus and the method thereof having improved displaying quality.

According to the object of the present invention, a method for driving a liquid crystal display (LCD) is provided. The method receives a pixel value and drives a pixel of the LCD according to the pixel value during a frame period which is divided into a precharge field and a compensation field. First, a precharge pixel value is deceded to be a predetermined first pixel value or a predetermined second pixel value according to the pixel value. Then, a compensation pixel value is decided. Next, a precharge driving voltage is decided according to the precharge pixel value, and a compensation driving voltage is decided according to the compensation pixel value. Then, drive the pixel according to the precharge driving voltage during the precharge field; and drive the pixel according to the compensation driving voltage during the compensation field. The lightness of the pixel driven according to the precharge pixel value and the compensation pixel value is substantially the same with the lightness of the pixel if driven according to the pixel value.

According to another object of the present invention, a liquid crystal display (LCD) driving apparatus is provided. The apparatus receives a pixel value and drives a pixel of the LCD according to the pixel value during a frame period which is divided into a precharge field and a compensation field. The driving apparatus includes a field controller, a mathematic unit, and a source driver. The field controller receives a first synchronization signal and thereby outputs a second synchronization signal. The mathematic unit receives the pixel value, determines a precharge pixel value and a compensation pixel value, and selectively outputs one of the precharge pixel value and the compensation pixel value according to the second synchronization signal. The source driver generates a precharge driving voltage and a compensation driving voltage according to the precharge pixel value and the compensation pixel value respectively, and driving the pixel by the precharge driving voltage during the precharge field and driving the pixel by the compensation driving voltage during the compensation field.

BRIEF DESCRIPTION OF THE DRAWINGS

Other objects, features, and advantages of the invention will become apparent from the following detailed description of the preferred but non-limiting embodiments. The description is made with reference to the accompanying drawings in which:

FIG. 16B shows the table used by the look up unit.

DESCRIPTION OF THE PREFERRED EMBODIMENT

Figure 1:
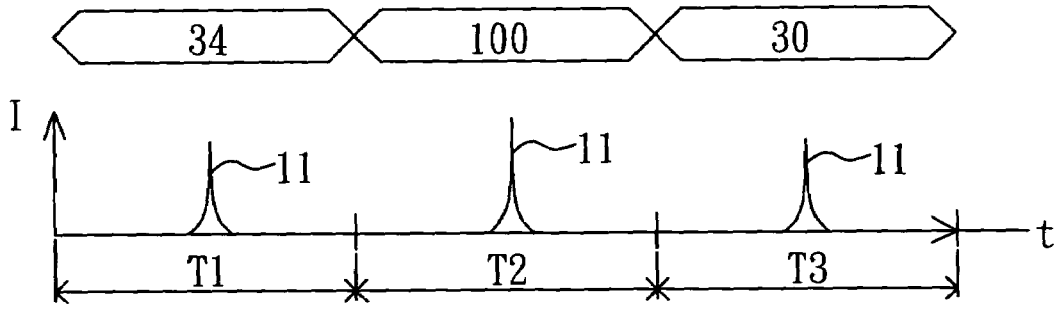
FIG. 1(PRIOR ART)
FIG. 1 (Prior Art) shows the relation of lightness l for one pixel and time t according to the display of CRT.
Figure 2A:
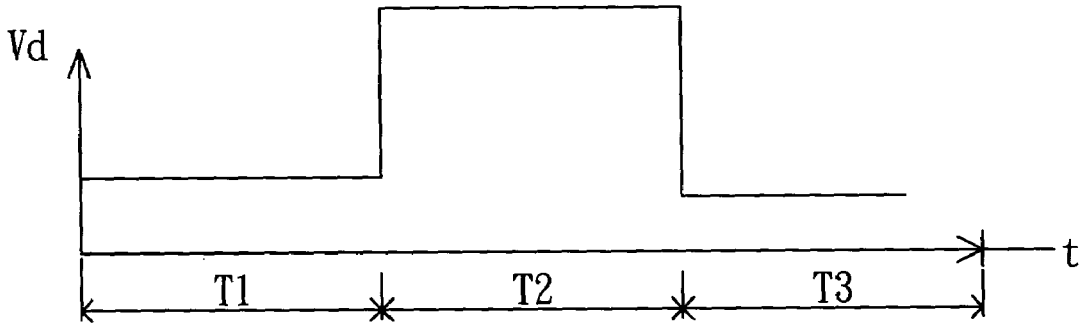
FIG. 2A(PRIOR ART)
FIG. 2A (Prior Art) shows the relation of time t and driving voltage Vd applied to the pixel according to the display of LCD.
Figure 2B:
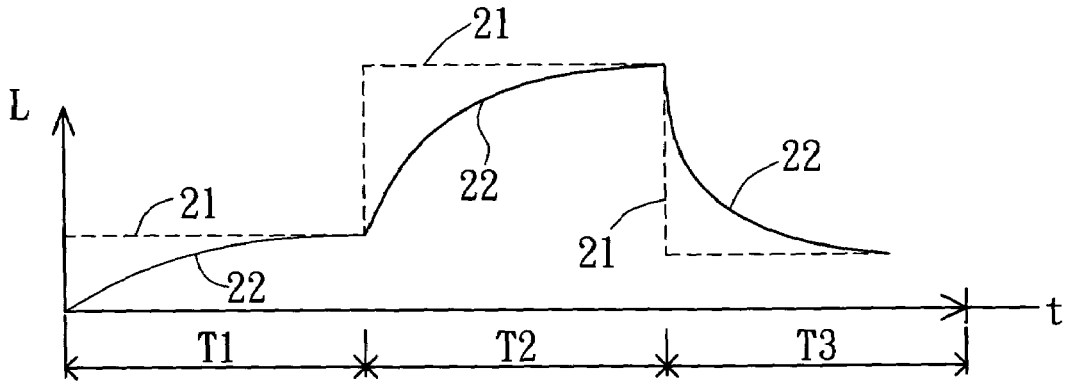
FIG. 2B(PRIOR ART)
FIG. 2B (Prior Art) shows the relation of time t and the lightness L for pixel provided with the voltages of FIG. 2A.
Figure 3A:
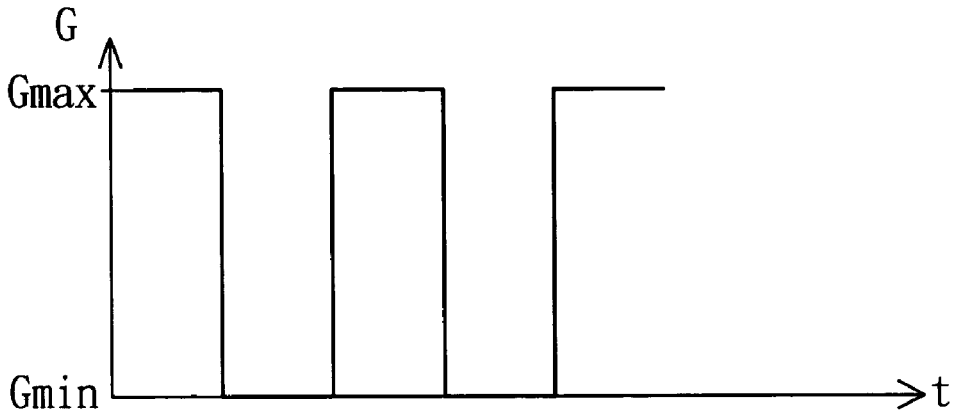
FIG. 3A(PRIOR ART)
FIG. 3A (Prior Art) shows the situation wherein the liquid crystal molecules have the shortest response time.

The responding speed of the liquid crystal molecule is related to the present state and the target state of the liquid crystal molecule. Referring to FIG. 3A, it shows the situation wherein the liquid crystal molecules have the shortest response time. When the pixel value G rises from the minimum pixel value Gmin to the maximum pixel value Gmax, or descends from the maximum pixel value Gmax to the minimum pixel value Gmin, the liquid crystal molecules have the shortest response time.

Figure 3B:
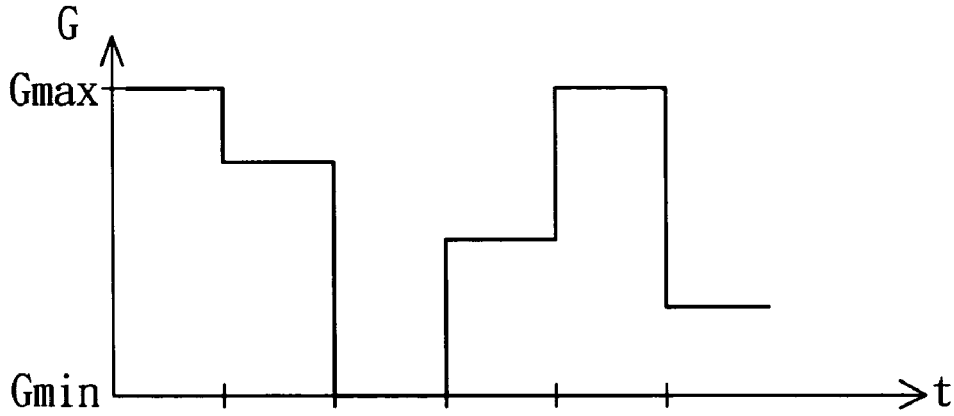
FIG. 3B(PRIOR ART)
FIG. 3B (Prior Art) shows the situation wherein the liquid crystal molecules have the intermediate response time.

Referring to FIG. 3B, it shows the situation wherein the liquid crystal molecules have the intermediate response time. When the pixel value G rises from the minimum pixel value Gmin to the intermediate pixel value, or from the intermediate pixel value to the maximum pixel value Gmax, or falls from the maximum pixel value Gmax to the intermediate pixel value, or from the maximum pixel value Gmax to the intermediate pixel value, the liquid crystal molecule has the intermediate response time.

Figure 3C:
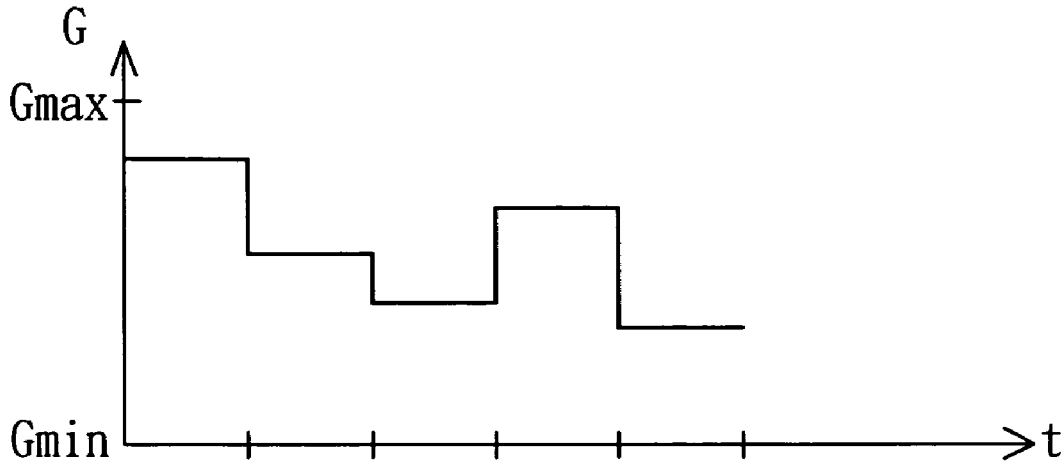
FIG. 3C(PRIOR ART)
FIG. 3C (Prior Art) shows the situation wherein the liquid crystal molecules have the longest response time.

Referring to FIG. 3C, it shows the situation wherein the liquid crystal molecules have the longest response time. When the pixel value G changes from one intermediate pixel value to the other intermediate pixel value, the liquid crystal molecules have the longest response time. The situation of FIG. 3C should be avoided to enhance the display quality.

In the following embodiment, the refresh rate of the LCD is assumed to be 60 Hz, and the resolution is assumed to be 800×600. The displaying process of a traditional liquid crystal display (LCD) is controlled by a vertical synchronization signal Vs and a horizontal synchronization signal Hs. There are 60 frames to be displayed in one second according to the vertical synchronization signal Vs having the frequency of 60 Hz, which is denoted as f(Vs), and thus the corresponding frame period is 1/60=16.7 ms. Each frame has 600 horizontal lines, which are scanned orderly by the control of Hs signal, and thus the frequency of the Hs signal is f(Hs)=600*f(Vs) =36,000 Hz. Each horizontal line has 800 points, and each point includes a red, blue, and a green pixel. So that, each horizontal line has 800*3=2400 pixels. The frequency of the pixel clock signal Cp, for controlling the input of the pixel bit stream into the LCD, is f(Cp)=2400*f(Hs)=86,400,000 Hz. The pixel value is supposed to have 8 bits, 0~255 gray levels, and the corresponding driving voltage is 0~5V. The relation of the pixel value and the driving voltage is not necessarily linear, and is obtained by looking up a table, for example.

Figure 4A:
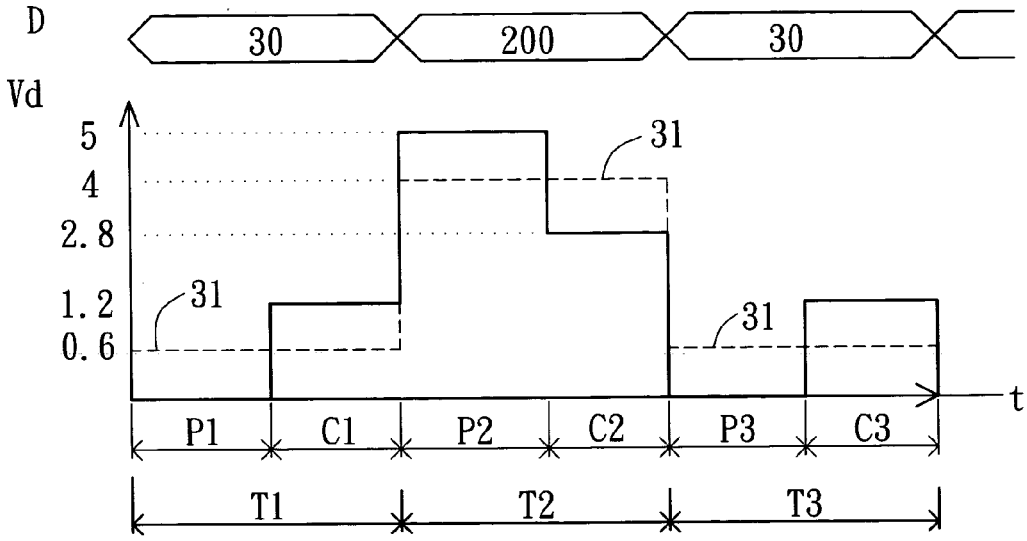
FIG. 4A shows the driving voltage according to a first embodiment of the driving method for an LCD.

Referring to FIG. 4A, it shows the driving voltage of the driving method for an LCD according to a first embodiment of the invention. The pixel values D in the frame periods T1, T2, and T3 are supposed to be respectively 30, 200, and 30. By conventional driving method, the corresponding driving voltages in the frame period T1, T2, and T3 are, for instance, 0.6V, 4V, and 0.6V, as shown by dash line 31 in FIG. 4A. However, the conventional method has the disadvantage of long response time.

The first embodiment of the present invention divides a frame period into a compensation field C and a precharge field P prior to the compensation field. The precharge pixel value of the precharge field P is either a predetermined high pixel value Gmax, which is for example the maximum pixel value in the first embodiment, or a predetermined low pixel value Gmin, which is for example the minimum pixel value in the first embodiment. The compensation pixel value corresponding to the compensation field is determined according to the pixel value and the precharge pixel value. In the first embodiment, the pixel value is approximately the average of the precharge field P and the corresponding compensation field C.

The frame period T1 is divided into a precharge field P1 and a compensation field C1; the frame period T2 is divided into a precharge field P2 and a compensation field C2; the frame period T3 is divided into a precharge field P3 and a compensation field C3.

First, a precharge pixel value of the precharge field P is determined. If the pixel value of the frame period is larger than a reference value, the precharge pixel value will be the predetermined high pixel value Gmax. If the pixel value of the frame period is smaller than the reference value, the precharge pixel value will be the predetermined low pixel value Gmin. The reference value is adjusted according to the characteristic of the LCD. Here, the reference value is supposed to be 128.

The pixel value of the frame period T1 is 30, being smaller than the reference value of 128, so the precharge pixel value of the precharge field P1 is the predetermined low pixel value Gmin of 0. Hence, the compensation pixel value of the compensation field C1 is determined to be 60 so that the average of the compensation pixel value and the precharge pixel value is substantially the pixel value of frame period T1.

The pixel value of the frame period T2 is 200, being larger than the reference value of 128, so that the precharge pixel value of the precharge field P2 is the predetermined high pixel value Gmax of 255. The compensation pixel value of the compensation field C2 is accordingly determined to be 145, so that the pixel value of the frame period T2, being 200, is the average of the precharge pixel value of the precharge field P2 and the compensation pixel value of the compensation field C2.

The pixel of the frame period T3 is 30, being smaller than the reference value of 128, such that the precharge pixel value of the precharge field P3 is determined to be the predetermined low pixel value Gmin of 0. The compensation pixel value of the compensation field C3 is accordingly determined to be 60, so that the pixel of the frame period T3, being 30, is the average of the precharge pixel value of the precharge field P3 and the compensation pixel value of the compensation field C3.

The driving voltages are decided according to the precharge pixel value and the compensation pixel value by, for instance, looking up a table. The driving voltages in each field of this embodiment is 0V, 1.2V, 5V, 2.8V, 0V, 1.2V, as shown in FIG. 4A.

Figure 4B:
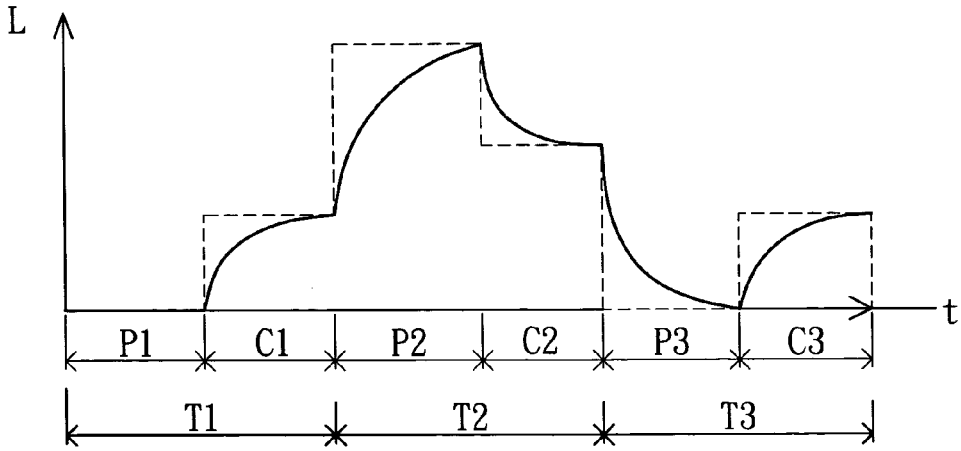
FIG. 4B shows the lightness of the pixel, to which the driving voltages of FIG. 4A are applied.

Referring to FIG. 4B, it shows the lightness of the pixel to which the driving voltages of FIG. 4A are applied. The dash line represents the ideal lightness of the pixel, and the solid line represents the real lightness of the pixel. For example, consider the frame period T2. The lightness of the pixel rises to the maximum during the precharge field P2. The rising time of this embodiment is shorter than that of the conventional method as a result of the larger driving voltage of this embodiment than that of the conventional one. The lightness of the pixel begins to fall during the compensation field C2. The falling time of this embodiment is shorter than that of the conventional method due to the smaller driving voltage of this embodiment than that of the conventional one. Moreover, the curve of the lightness for the frame period T2 is more like the display of the impulse type, such that the effect of the image residue is diminished. Furthermore, the long response time situation, as shown is FIG. 3C, is prevented either by approaching the intermediate pixel value from the predetermined high or low pixel value, or by starting from the intermediate pixel value to the predetermined high or low pixel value.

The predetermined high or low pixel value is not necessarily the maximum or the minimum pixel value and is dependent on the characteristics of the LCD.

Take frame period T2 for example. The lightness of frame period T2, which is the result of the lightness of precharge field P2 and that of the compensation field C2, is substantially equal to the lightness if the pixel is driven by the conventional method.

Figure 5A:
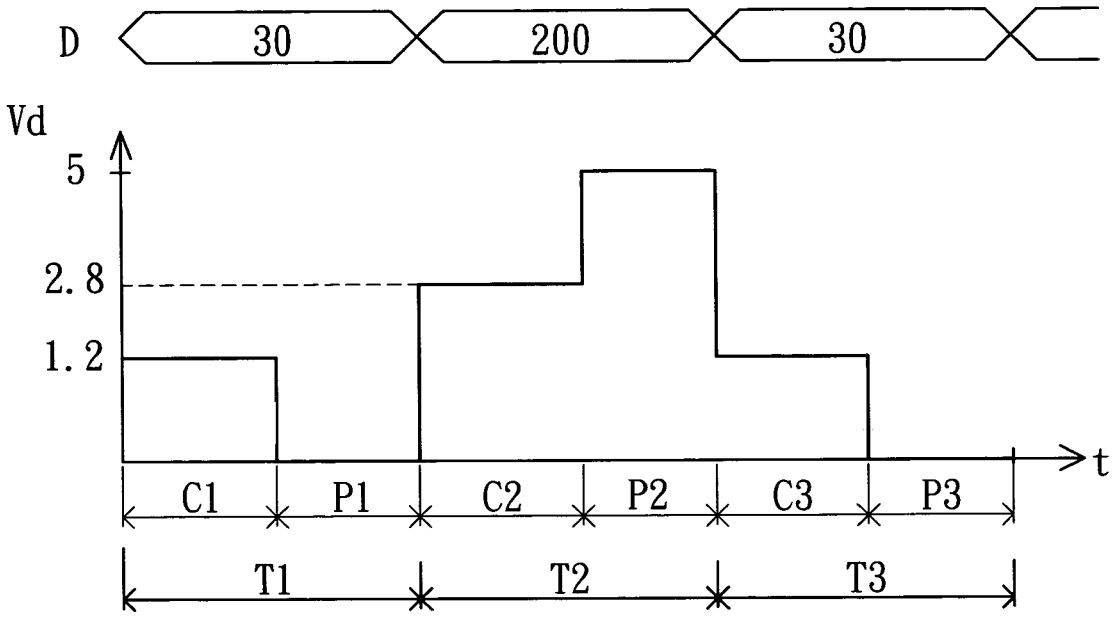
FIG. 5A shows the driving voltage of the other driving method for an LCD, wherein the compensation field is prior to the precharge field.

Referring to FIG. 5A, it shows the driving voltage of the other driving method for an LCD, wherein the compensation field is prior to the precharge field. The pixel values D in the frame period T1, T2, and T3 are supposed to be respectively 30, 200, and 30.

The frame period T1 is divided into a compensation field C1 and a precharge field P1; the frame period T2 is divided into a precharge field P2 and a compensation field C2; the frame period T3 is divided into a precharge field P3 and a compensation field C3.

The pixel value of the frame period T1 is 30, being smaller than the reference value of 128, so that the precharge pixel value of the precharge field P1 is determined to be the predetermined low pixel value Gmin of 0. The compensation pixel value of the compensation field C1 is accordingly determined to be 60, so that the pixel value for the frame period T1, being 30, is the average of the precharge pixel value of the precharge field P1 and the compensation pixel value of the compensation field C1.

The pixel value of the frame period T2 is 200, being larger than the reference value of 128, so that the precharge pixel value of the precharge field P2 is determined to be the predetermined high pixel value Gmax of 255. The compensation pixel value of the compensation field C2 is thereby determined to be 145, so that the pixel value of the frame period T2, being 200, is the average of the precharge pixel value of the precharge field P2 and the compensation pixel value of the compensation field C2.

The pixel value of the frame period T3 is 30, being smaller than the reference value of 128, so that the precharge pixel value of the precharge field P3 is determined to be the predetermined low pixel value Gmin of 0. The compensation pixel value of the compensation field C3 is thereby determined to be 60, so that the pixel value of the frame period T3, being 30, is the average of the precharge pixel value of the precharge field P3 and the compensation pixel value of the compensation field C3.

The driving voltage is decided according to the precharge pixel value and the compensation pixel value by, for instance, looking up a table. The driving voltage in each field of this embodiment is 1.2V, 0V, 2.8V, 5V, 1.2V, and 0V, as shown in FIG. 5A.

Figure 5B:
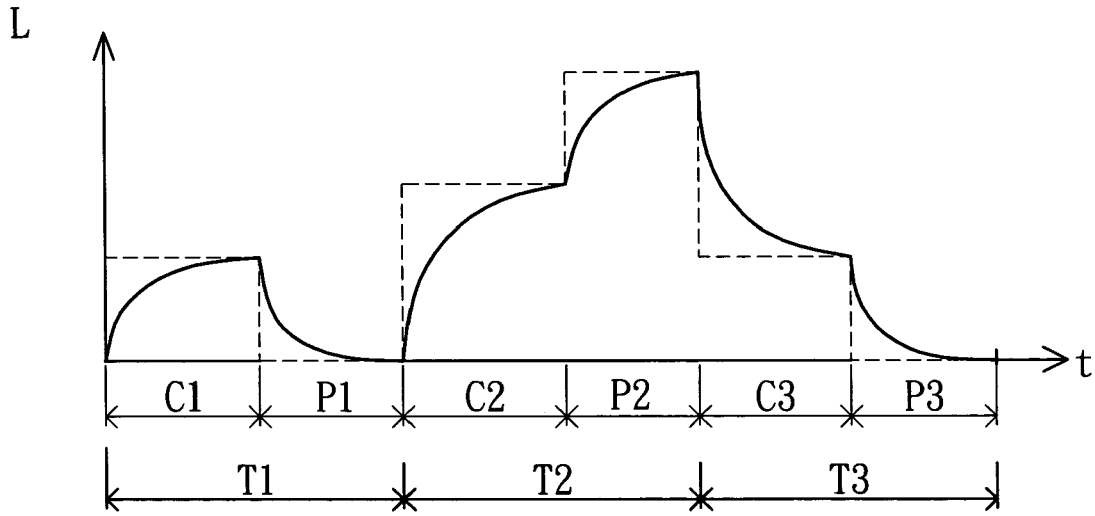
FIG. 5B shows the lightness of the pixel, to which the driving voltages of FIG. 5A are applied.

Referring to FIG. 5B, it shows the lightness of the pixel, to which the driving voltages of FIG. 5A are applied. The dashed line represents the ideal lightness of the pixel, and the solid line represents the real lightness of the pixel. The longest response time situation, as shown in FIG. 3C, is avoided in this embodiment by either approaching the intermediate pixel value from the predetermined high or low pixel value, or by starting from the intermediate pixel value to the predetermined high or low pixel value.

Figure 6:
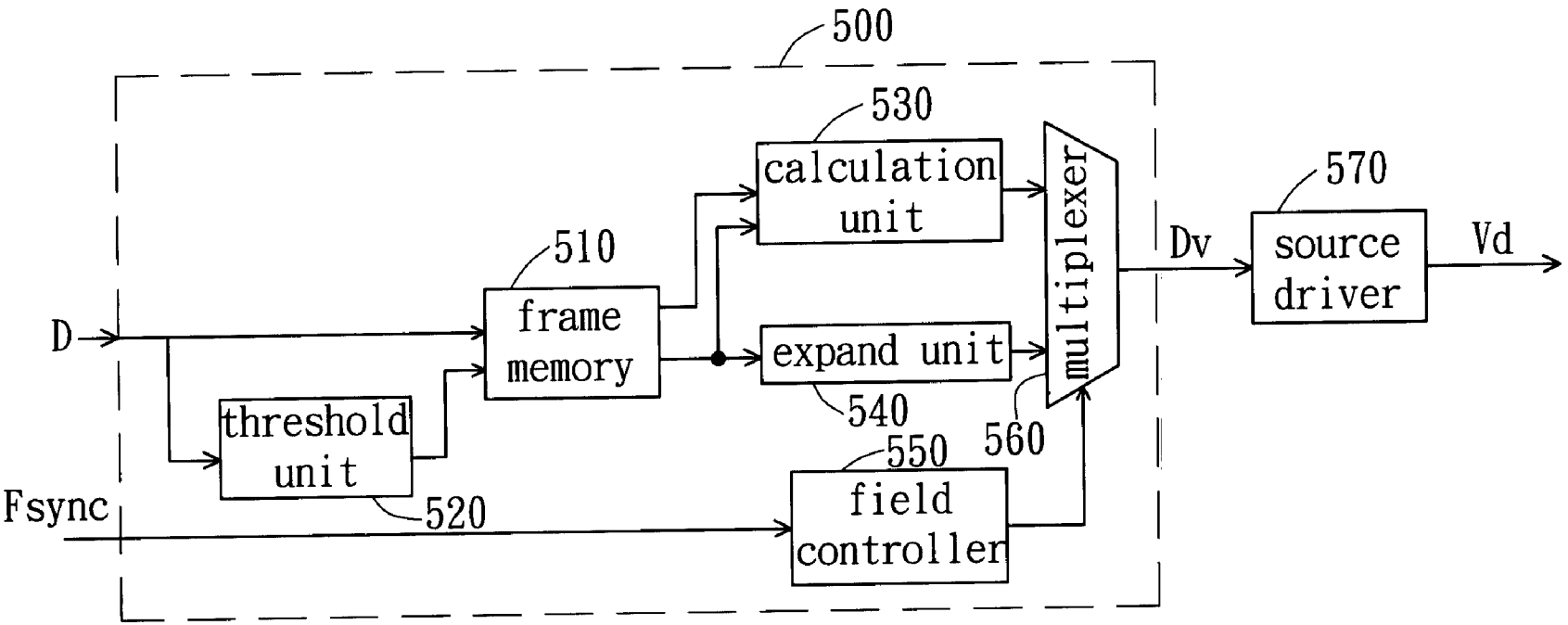
FIG. 6 shows the block diagram of an LCD driving apparatus according to a second embodiment of the present invention.

Referring to FIG. 6, it shows the block diagram of an LCD driving apparatus according to a second embodiment of the present invention. The driving apparatus 500 includes a frame memory 510, a mathematic unit, and a field controller 550. The mathematic unit includes a threshold unit 520, a calculation unit 530, an expand unit 540, and a multiplexer 560. The LCD driving apparatus 500 receives a pixel value D and outputs driving value Dv, which is either the precharge pixel value or the compensation pixel value. Then, the source driver 570 thereby outputs driving voltage Vd to drive the LCD.

For example, consider the LCD having the refresh rate of 60 Hz, for which 60 frames are displayed in each second. The pixel value D is inputted into the LCD driving apparatus 500 according to the above-mentioned pixel clock signal Cp. The LCD driving apparatus 500 outputs the driving values Dv according to the pixel clock signal Cp', whose frequency is double of the pixel clock signal Cp, because that one frame period is divided into a compensation field and a precharge field.

First, the LCD driving apparatus 500 receives the pixel value D, saves the pixel value D in the frame memory 510, and sends the pixel value D to the threshold unit 520. The threshold unit 520 compares the pixel value D with a reference value: if the pixel value D is larger than the reference value, a threshold value from the threshold unit 520 will be a first value and be saved in the frame memory 510; otherwise, it will be a second value and be saved in the frame memory 510.

Then, the calculation unit 530 outputs a compensation pixel value according to the pixel value D and the threshold value from the frame memory 510. If the threshold value is the second value, the compensation driving voltage is determined according to the double of the pixel value D. Otherwise, the compensation voltage is determined according to the result of double of the pixel value D minus the predetermined high pixel value.

The expand unit 540 receives the threshold value from the frame memory 510 and outputs a precharge pixel value. If the threshold value is the first value, the precharge pixel value will be the predetermined high pixel value; otherwise, it will be the predetermined low pixel value. The field controller 550 controls the multiplexer 560 to output the precharge pixel value or a compensation pixel value according to the second synchronization signal derived from the first synchronization signal Fsync. The sequence of the precharge field and the compensation field is decided by the field controller 550.

Figure 7:
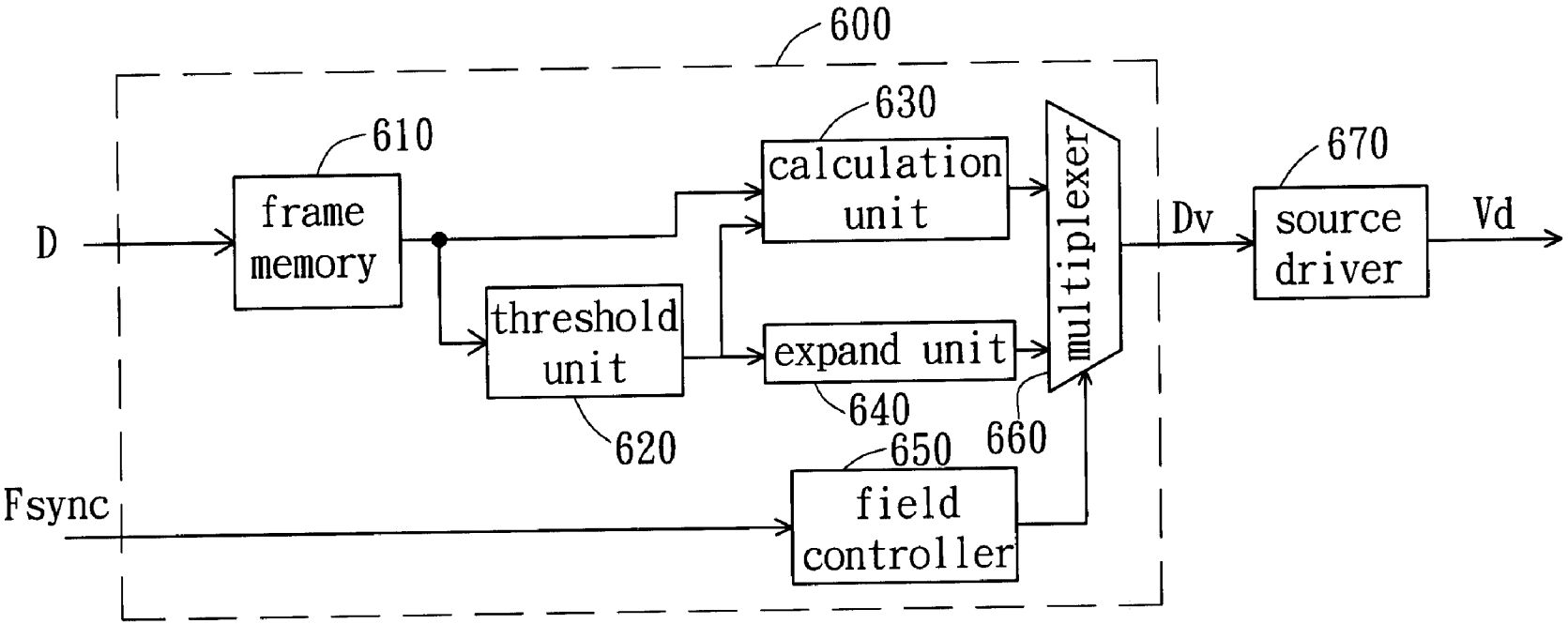
FIG. 7 shows the block diagram of an LCD driving apparatus according to a third embodiment of the present invention.

Referring to FIG. 7, it shows the block diagram of an LCD driving apparatus according to a third embodiment of the present invention. The LCD driving apparatus 600 includes a frame memory 610, a mathematic unit, and a field controller 650. The mathematic unit includes a threshold unit 620, a calculation unit 630, an expand unit 640, and a multiplexer 660. The LCD driving apparatus 600 receives the pixel value D and outputs a driving value Dv, which is either the precharge pixel value or the compensation pixel value, and thereby the source driver 670 outputs driving voltage Vd to drive the LCD.

For example, consider the LCD having the refresh rate of 60 Hz, for which 60 frames are displayed in each second. The pixel value D is inputted into the LCD driving apparatus 600 according to the pixel clock signal Cp. The LCD driving apparatus 600 outputs of the driving voltage Vd according to the pixel clock signal Cp', whose frequency is double of the pixel clock signal Cp, because that one frame period is divided into the compensation field and the precharge field.

First, the driving apparatus 600 receives the pixel value D, and saves the pixel value D in the frame memory 610. The threshold unit 620 compares the pixel value D with a reference value: if the pixel value D is larger than the reference value, a threshold value from the threshold unit 620 will be the first value; otherwise, it will be the second value.

Then, the calculation unit 630 outputs a compensation pixel value according to the pixel value D and the threshold value: if the threshold value is the second value, the compensation pixel value will be decided according to double of the pixel value D; otherwise, the compensation pixel value will be determined according to the result of double of the pixel value D minus the predetermined high pixel value.

The expand unit 640 receives the threshold value and outputs a precharge pixel value. If the threshold value is the first value, the precharge pixel value will be the predetermined high pixel value; otherwise, it will be the low pixel value. The field controller 650 controls the multiplexer 660 to output the precharge pixel value or the compensation pixel value according to the first synchronization signal Fsync. The field controller 650 decides the sequence of the precharge field and the compensation field.

Figure 8:
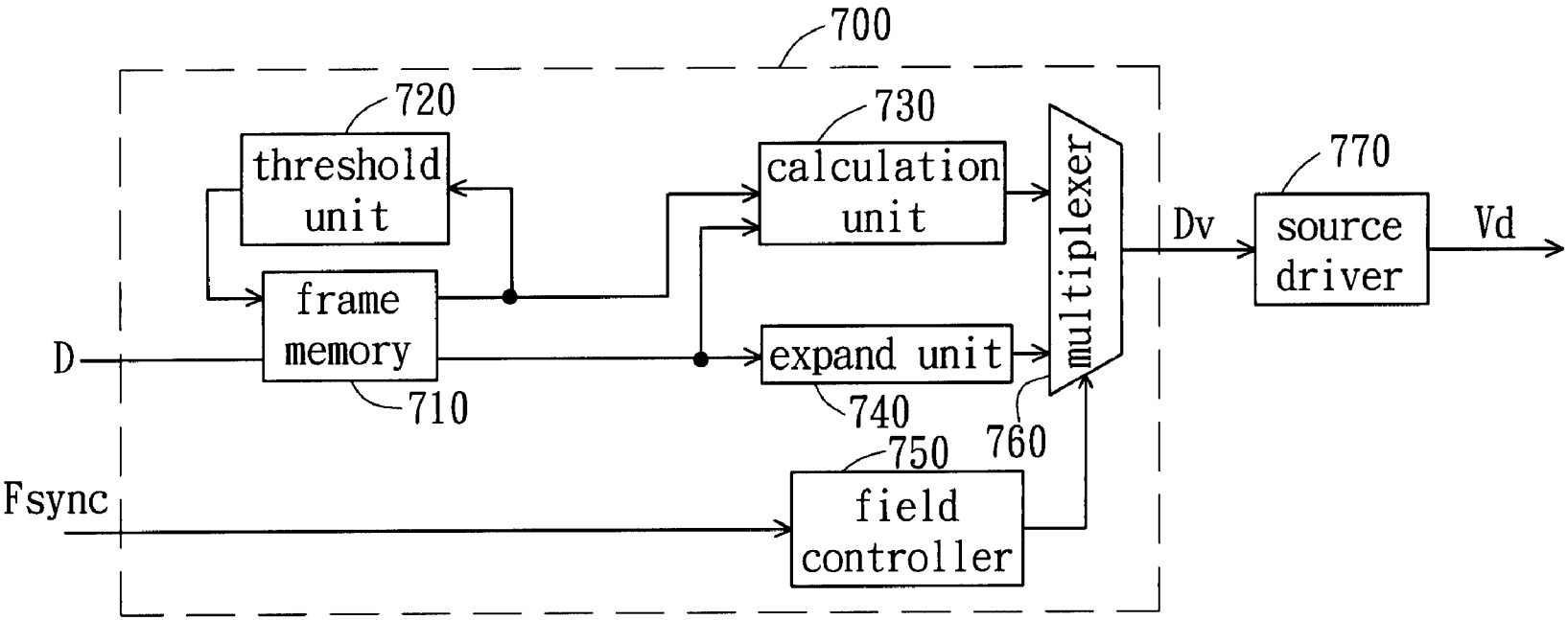
FIG. 8 shows the block diagram of an LCD driving apparatus according to a fourth embodiment of the present invention.

Referring to FIG. 8, it shows the block diagram of an LCD driving apparatus according to a fourth embodiment of the present invention. The driving apparatus 700 includes a frame memory 710, a mathematic unit, and a field controller 750. The mathematic unit includes a threshold unit 720, a calculation unit 730, an expand unit 740, and a multiplexer 760. The LCD driving apparatus 700 receives the pixel value D and thereby the source driver 770 outputs the driving voltage Vd.

For example, consider the refresh rate of 60 Hz, for which 60 frames are displayed in each second. The pixel value D is inputted into the LCD driving apparatus 700 according to the pixel clock signal Cp. The LCD driving apparatus 700 outputs the driving voltage Vd according to the pixel clock signal Cp', whose frequency is double of the pixel clock signal Cp, because that one frame period is divided into the compensation field and the precharge field.

First, the LCD driving apparatus 700 receives the pixel value D, and saves the pixel value D in the frame memory 710. The frame memory 710 outputs the saved pixel value D and also the threshold value of the previous frame period. The threshold unit 720 compares the received pixel value D with a reference value. If the pixel value D is larger than the reference value, the threshold value from the threshold unit 720 will be the first value and be saved in the frame memory 710. Otherwise, it will be the second value.

The calculation unit 730 outputs a compensation pixel value according to the pixel value D and the threshold value of the previous frame period. When the pixel value is not larger than the reference value, the compensation pixel value is determined according to double of the pixel value D. Otherwise, the compensation voltage is determined according to the result of double of the pixel value D minus the predetermined high pixel value.

Then, The calculation unit 730 determines the over-driving tactic according to the threshold value of the previous frame period. When the threshold value of the previous frame period is the first value, the predetermined high pixel value is provided in the precharge field of the previous frame period. So, the over-driving tactic for increasing the responding speed is decreasing the compensation pixel value of the present frame period. When the threshold value of the previous frame period is the second value, the minimum pixel is provided in the precharge field of the previous frame period. So that, the over-driving tactic for increasing the responding speed is increasing the compensation driving voltage of the present frame period.

The expand unit 740 receives the threshold value and outputs a precharge pixel value. If the threshold value is the first value, the precharge pixel value will be the predetermined high pixel value. Otherwise, it will be the predetermined low pixel value. The field controller 750 controls the multiplexer 760 to output the precharge pixel value or the compensation pixel value according to the first synchronization signal Fsync.

Figure 9:
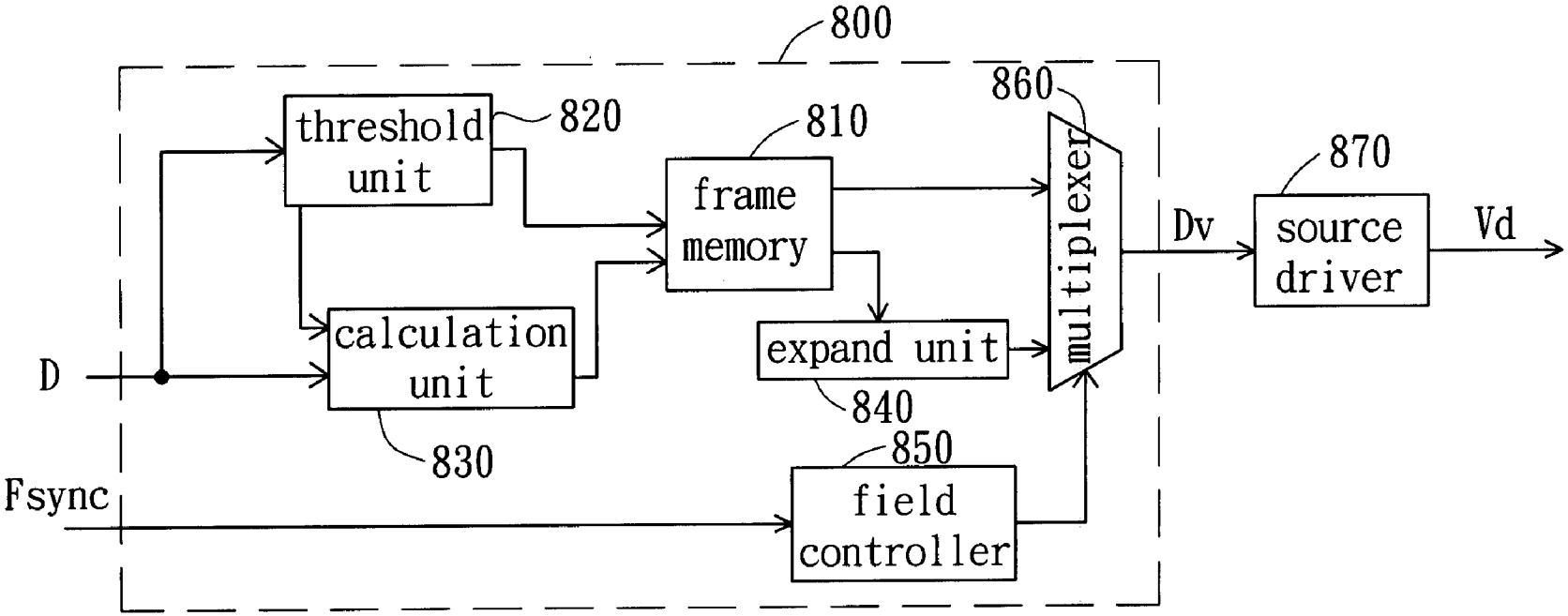
FIG. 9 shows the block diagram of an LCD driving apparatus according to a fifth embodiment of the present invention.

Referring to FIG. 9, it shows the block diagram of an LCD driving apparatus according to a fifth embodiment of the present invention. The precharge field is prior to the compensation field in the fifth embodiment, as compared with the fourth embodiment. The driving apparatus 800 includes a frame memory 810, a mathematic unit, and a field controller 850. The mathematic unit includes a threshold unit 820, a calculation unit 830, an expand unit 840, and a multiplexer 860. The LCD driving apparatus 800 receives the pixel value D and outputs driving value Dv, and thereby the source driver 870 outputs a driving voltage Vd.

For example, consider the LCD having the refresh rate of 60 Hz, for which 60 frames are displayed in each second. The pixel value D is inputted into the LCD driving apparatus 800 according to the above pixel clock signal Cp. The LCD driving apparatus 800 outputs the driving voltage Vd according to the pixel clock signal Cp', whose frequency is double of the pixel clock signal Cp, because that one frame period is divided into a precharge field and a compensation field.

First, the driving apparatus 800 receives the pixel value D, and delivers the pixel value D to the calculation unit 830 and the threshold unit 820. The threshold unit 820 compares the received pixel value D with a reference value. If the pixel value D is larger than the reference value, a threshold value outputted from the threshold unit 820 will be the first value and be delivered to the calculation unit 830 and the frame memory 810. Otherwise, it will be the second value.

Then, the calculation unit 830 outputs a compensation driving voltage according to the pixel value D and the threshold value from the frame memory 810. When threshold value is the second value, the compensation pixel value is determined according to double of the pixel value D. Otherwise, the compensation pixel value is determined according to the result of double of the pixel value D minus the predetermined high pixel value.

Then, the calculation unit 830 determines the over-driving tactic according to the threshold value. When the threshold value is the first value, the predetermined high pixel value is provided in the precharge field. So, the over-driving tactic of increasing the responding speed for the liquid crystal molecule is decreasing the compensation pixel value of the present frame period. When the threshold value of the previous frame period is the second value, the predetermined low pixel value is provided in the precharge field. So that, the over-driving tactic for increasing the responding speed for the liquid crystal molecule is increasing the compensation pixel value of the present frame period.

Next, the calculation unit 830 saves the compensation pixel value into the frame memory 810. The frame memory 810 outputs the saved compensation pixel value to the multiplexer 860 and outputs the threshold value to the expand unit 840.

The expand unit 840 receives the threshold value and outputs a precharge pixel value according to the threshold value. If the threshold value is the first value, the precharge pixel value will be the predetermined high pixel value. Otherwise, it will be the low pixel value. The field controller 850 controls the multiplexer 860 to output the precharge pixel value or the compensation pixel value according to the first synchronization signal Fsync.

The frame memory of the second, third, fourth, and fifth embodiments of the present invention saves the pixels of the whole frame. The frequency of Vs signal and the Hs signal should be doubled in displaying of the two pixel values corresponding to the precharge field and the compensation field during one frame period. Therefore, the Vs' signal is two times the frequency of the Vs signal, and the Hs' signal is two times the frequency of the Hs signal. In the second, third, fourth, and fifth embodiments of the present invention, the pixel values of all pixels for the first field are displayed orderly during the period of the Vs' signal, which is 1/120 second. Then, the pixel values of all pixels for the second field are displayed orderly during the next period of Vs' signal, which is 1/120 second.

Figure 10:
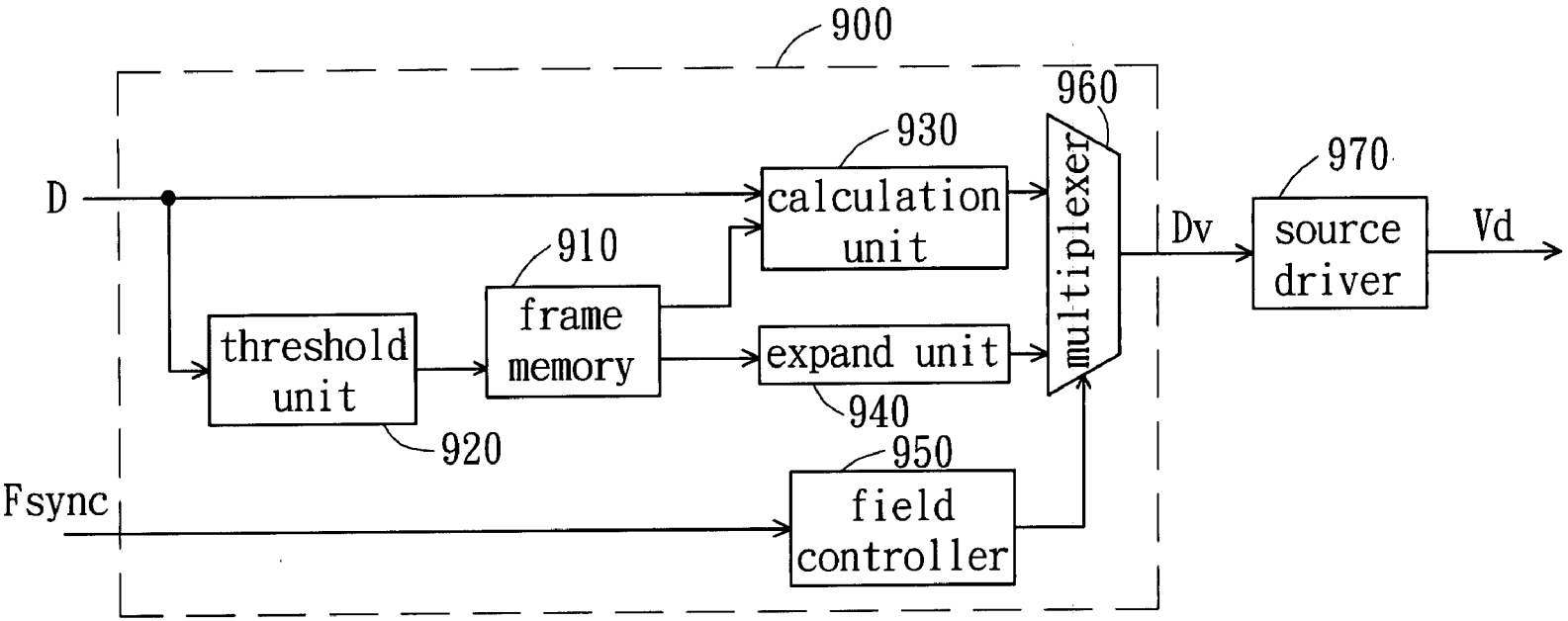
FIG. 10 shows the block diagram of an LCD driving apparatus according to a sixth embodiment of the present invention.

Referring to FIG. 10, it shows the block diagram of an LCD driving apparatus according to a sixth embodiment of the present invention. The LCD driving apparatus 900 includes a frame memory 910, a mathematic unit, and a field controller 950. The mathematic unit includes a threshold unit 920, a calculation unit 930, an expand unit 940, and a multiplexer 960. The LCD driving apparatus 900 receives the pixel value D and outputs a driving value, and thereby the source driver 970 outputs the driving voltage Vd.

For example, consider the LCD having the refresh rate of 60 Hz, for which 60 frames are displayed in each second. The pixel value D is inputted into the LCD driving apparatus 900 according to the pixel clock signal Cp. The LCD driving apparatus 900 outputs the driving voltage Vd according to the pixel clock signal Cp', whose frequency is double of the pixel clock signal Cp, because that one frame period is divided into a precharge field and a compensation field.

First, the LCD driving apparatus 900 receives the pixel value D, and delivers the pixel value D to the calculation unit 930 and the threshold unit 920. The threshold unit 920 compares the received pixel value D with a reference value. If the pixel value D is larger than the reference value, a threshold value outputted from the threshold unit 920 will be the first value and be delivered to the frame memory 910. Otherwise, it will be the second value. The frame memory 910 outputs the threshold value to the calculation unit 930 and the expand unit 940.

Then, the calculation unit 930 outputs a compensation driving voltage according to the pixel value D and the threshold value from the frame memory 910. When threshold value is the second value, the compensation pixel value is determined according to the double of the pixel value D. Otherwise, the compensation pixel value is determined according to the result of double of the pixel value D minus the predetermined high pixel value.

The expand unit 940 receives the threshold value and outputs a precharge pixel value according to the threshold value. If the threshold value is the first value, the precharge pixel value will be the predetermined high pixel value. Otherwise, it will be the predetermined low pixel value. The field controller 950 controls the multiplexer 860 to output the precharge pixel value or the compensation pixel value according to the first synchronization signal Fsync.

In the second, third, fourth, and fifth embodiment of the present invention, the pixels of whole image is saved by the frame memory. However, the threshold value of each pixel, only having one bit, is saved by the frame memory 910 according to the sixth embodiment. Therefore, the sixth embodiment could efficiently decrease the needed memory required by the LCD driving apparatus 900.

Figure 11A:
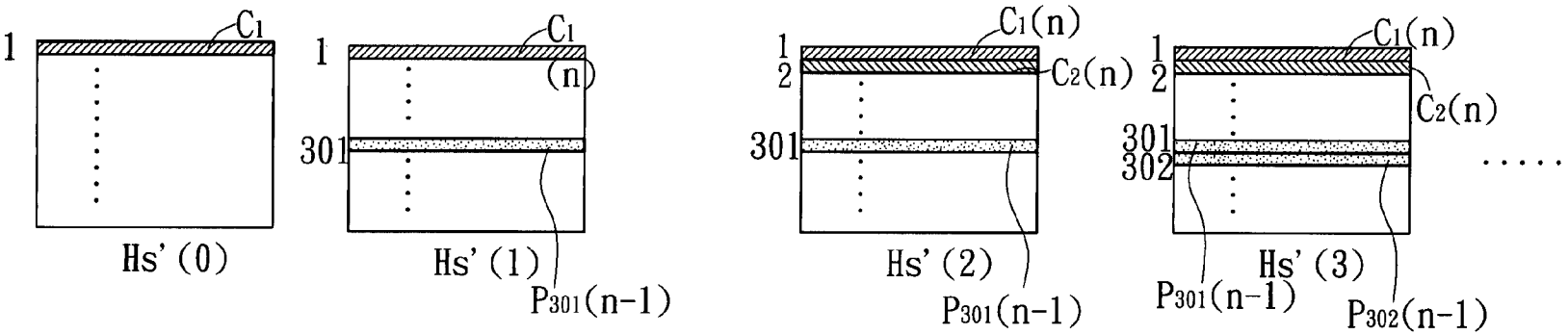
FIG. 11A shows the scanning process while receiving the pixel values for the upper part of the nth frame.
Figure 11B:
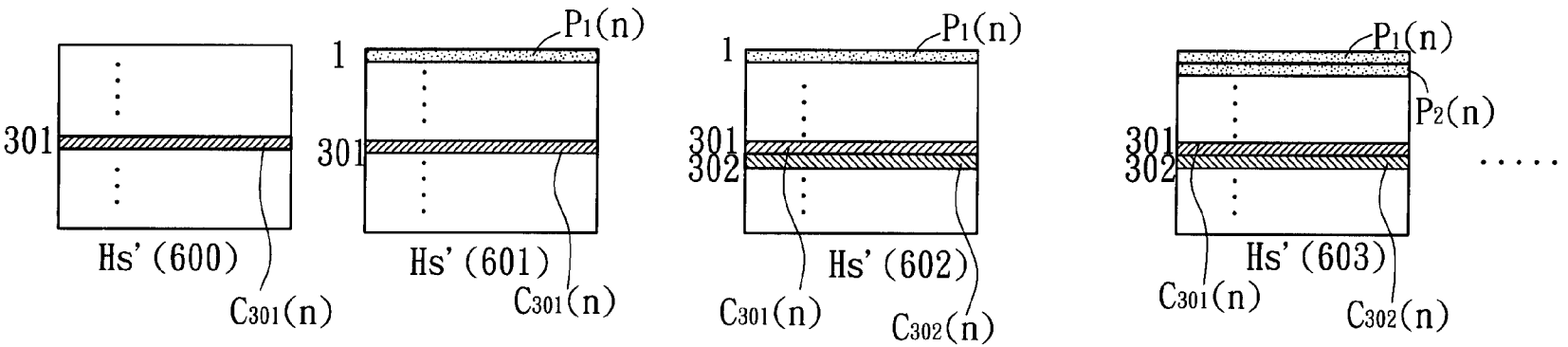
FIG. 11B shows the scanning process while receiving the pixel values for the lower part of the nth frame.

Another scanning method is needed in the sixth embodiment because the pixels of the all image are not saved by the frame memory 910 and each pixel is instantaneously processed for outputting. Referring to FIGS. 11A and 11B, they show the scanning process for the nth frame period according to the sixth embodiment. For example, consider the compensation field is prior to the precharge field. The frequency for the Hs' signal is the two times the frequency of the Hs signal. The frequency for the Vs' signal is same as the Vs signal.

The bit stream of the pixel values is inputted into the LCD driving apparatus according to the pixel clock signal Cp. The pixel values for one frame are inputted completely in 1/60 second, and the pixels for one horizontal line are inputted completely in two cycles of the Hs' signal. In the sixth embodiment, the pixels are instantaneously processed and displayed due to the lacking of memory for saving the pixel values when the pixel values for one horizontal line are received. The frame is divided into an upper part and a lower part, which are respectively corresponding to the horizontal lines 1~300 and the horizontal lines 301~600.

FIG. 11A shows the scanning process while receiving the pixel values for the upper part of the nth frame, wherein the first cycle of the Hs' signal at the very beginning is Hs'(0). The pixel values for each horizontal line are inputted at the each even cycles, such as Hs'(0), Hs'(2), Hs'(4), and so on. At the Hs'(0), the pixel values of the 1st horizontal line are inputted, and the compensation pixel values $C_1(n)$ for the 1st horizontal line of the nth frame are displayed. The threshold values of each pixel for the first horizontal line are saved in the frame memory.

At the Hs'(1), the pixel values of the 2nd horizontal line for the upper part are not inputted yet, and so that the precharge pixel values $P_{301}$ (n−1) corresponding to the pixels of the (n−1)th frame for the 301st line, the 1thc horizontal line for the lower part, is displayed. The precharge pixel values $P_{301}$ (n−1) are decided according to the threshold value saved in the frame memory.

At the Hs'(2), the pixel values of the 2nd horizontal line for the upper part are inputted. The precharge pixel values $C_2$ (n) corresponding to each pixels of the 2nd horizontal line is displayed. The threshold values corresponding to each pixel values for the 2nd horizontal line are saved in the frame memory.

At the Hs'(3), the pixel values of the 3rd horizontal line for the upper part are not inputted yet. The precharge pixel values $P_{302}$ (n−1) corresponding to the pixels of the (n−1)th frame for the 302nd horizontal line, the 2nd horizontal line for the lower part, is displayed. The precharge pixel values $P_{302}$ (n−1) are decided according to the threshold value saved in the frame memory.

The followings are deduced by analogy. Until the Hs'(599), the precharge pixel values corresponding to the (n−1)th frame for the lower part and the precharge pixel values corresponding to the nth frame for the upper part have been displayed.

FIG. 11B shows the scanning process while receiving the pixel values for the lower part of the nth frame. At the Hs' (600), the pixel values of the 301st horizontal line are inputted, and the compensation pixel values $C_{301}$(n) for the 301st horizontal line are displayed. The threshold values of pixels for the 301st horizontal line are saved in the frame memory.

At the Hs'(601), the pixel values of the 302nd horizontal line for the lower part are not inputted yet. The precharge pixel values $P_1$(n) corresponding to the pixels of the nth frame for the 1st line of the nth frame is displayed. The precharge pixel values $P_1$(n) are decided according to the threshold value saved in the frame memory.

At the Hs'(602), the pixel values of the 302nd horizontal line are inputted. The precharge pixel values $C_{302}$(n) corresponding to pixels of the 302nd horizontal line is displayed. The threshold values corresponding to pixels for the 302nd horizontal line are saved in the frame memory.

At the Hs'(603), the pixel values of the 303rd horizontal line are not inputted yet. The precharge pixel values $P_2$(n) corresponding to the pixels of the nth frame for the 2nd horizontal line is displayed.

The followings are deduced by analogy. Until the Hs' (1199), the precharge pixel values corresponding to the lower part for the nth frame and the precharge pixel values corresponding to the upper part for the nth frame have been displayed. Therefore, one frame can be completely displayed in one period of Vs signal.

Figure 12:
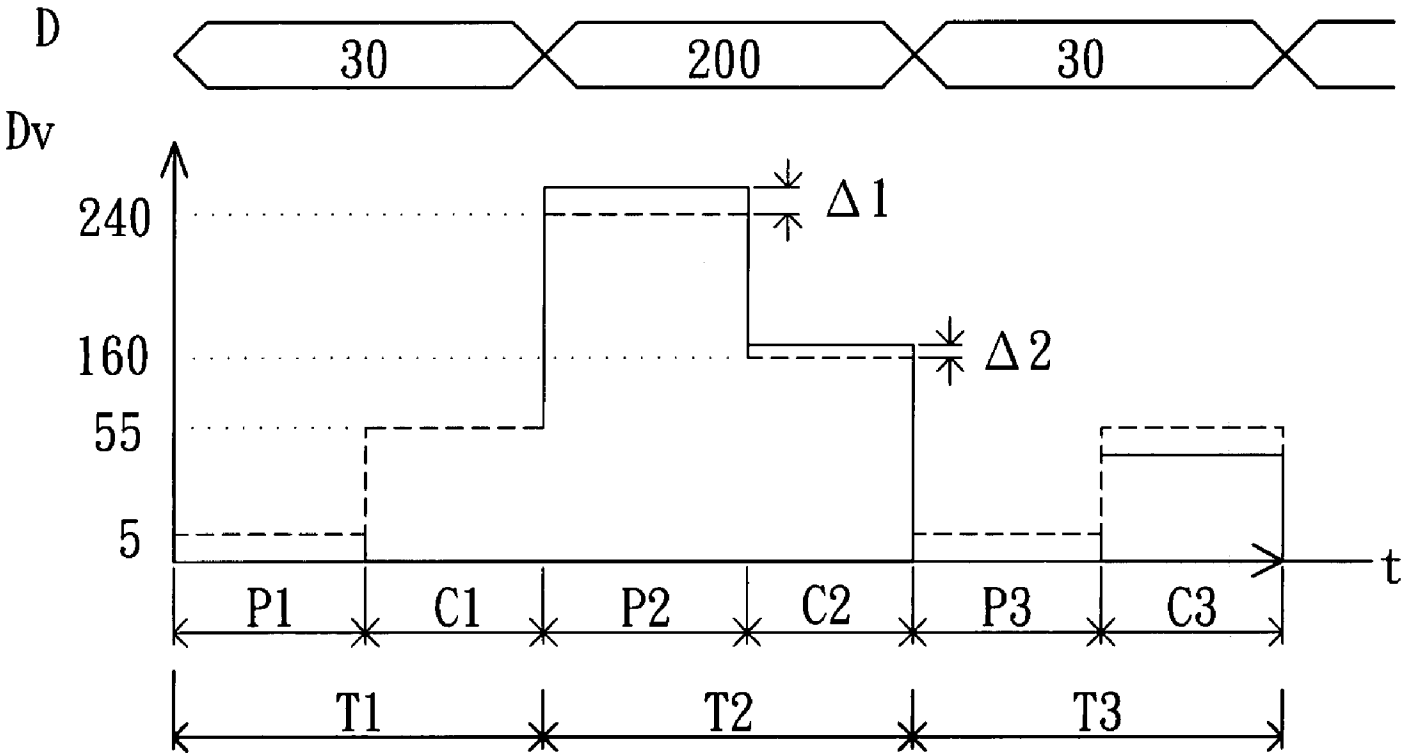
FIG. 12 shows the driving voltage of the driving method for an LCD according to a seventh embodiment of the invention.

Referring to FIG. 12, it shows the driving voltage of the driving method for an LCD according to a seventh embodiment of the invention. The pixel values D in the frame periods T1, T2, and T3 are supposed to be respectively 30, 200, and 30. The precharge field is prior to the compensation field in this embodiment. The compensation pixel value and the precharge pixel value are further compensated for overdriving. The precharge pixel value is either a first pixel value or a second pixel value, for example 5 and 240 respectively. The compensation pixel value is calculated such that the lightness of the frame period is substantially the same with lightness driven by the pixel value in the conventional method. The average of the compensation pixel value and the precharge pixel value substantially equals to the pixel value in this embodiment.

First, calculate the precharge pixel values and the compensation pixel values of the frame periods by the method of the first embodiment. The pixel value of the frame period T1 is 30, being smaller than the reference value of 128, so the precharge pixel value of the precharge field P1 is the second pixel value, which is 5 in this embodiment. Hence, the compensation pixel value of the compensation field C1 is determined to be 55. The pixel value of the frame period T2 is 200, being larger than the reference value of 128, so the precharge pixel value of the precharge field P2 is the first pixel value, which is 240 in this embodiment. Hence, the compensation pixel value of the compensation field C2 is determined to be 160. The pixel value of the frame period T3 is 30, being smaller than the reference value of 128, so the precharge pixel value of the precharge field P3 is the second pixel value, which is 5 in this embodiment. Hence, the compensation pixel value of the compensation field C3 is determined to be 55.

Then, determine the overdrive compensation value. The pixel value of frame period T2 is 200, being larger than that of the previous frame period T1, so the precharge pixel value of the precharge field P2 is added an overdrive compensation value Δ1 and the compensation pixel value of the compensation field C2 is added an overdrive compensation value Δ2 for increasing the response speed of the liquid crystal molecules. The overdrive compensation values Δ1 and Δ2 are respectively 10 and 2 for example.

The overdrive compensation values can be determined according to the pixel value of the current frame period and that of the previous frame period. A table can be established according to the characteristics of the LCD in order to look for the best overdrive compensation values.

In this embodiment, both the precharge pixel value and the compensation pixel value are overdrivingly compensated, or only one of them is overdrivingly compensated. In addition, the overdrive compensation values can be determined according to the pixel values of previous frame periods, previous precharge fields, or previous compensation fields.

Besides, the sequence of the precharge field and the compensation field can be dynamically swapped according to the pixel values of each fields, for example.

Figure 13:
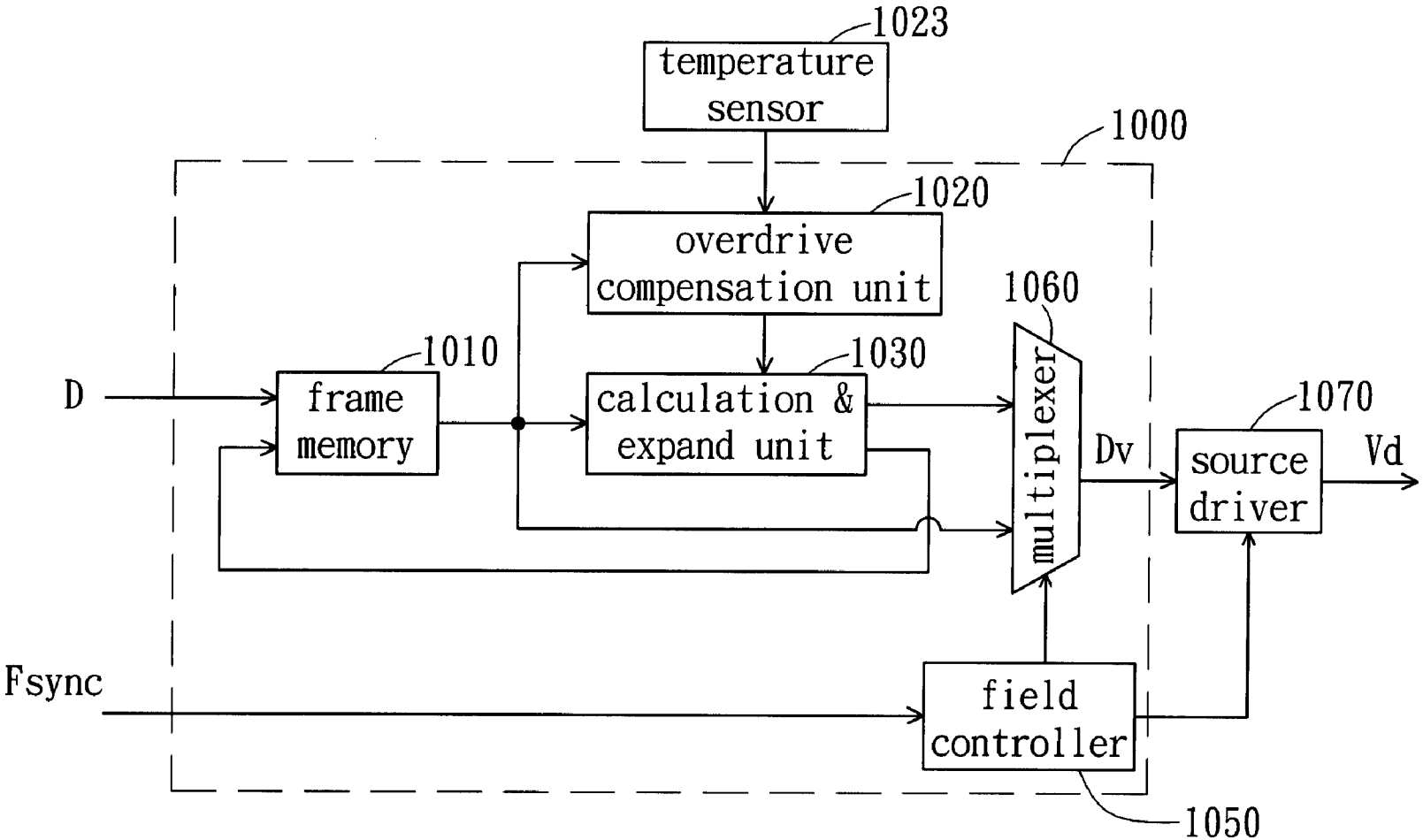
FIG. 13 shows the block diagram of an LCD driving apparatus according to an eighth embodiment of the present invention.

Referring to FIG. 13, it shows the block diagram of an LCD driving apparatus according to an eighth embodiment of the present invention. The driving apparatus 1000 includes a frame memory 1010, a mathematic unit, and a field controller 1050. The mathematic unit includes a overdrive compensation unit 1020, a temperature sensor 1023, a calculation&expand unit 1030, and a multiplexer 1060. The LCD driving apparatus 1000 receives a pixel value D and outputs driving value Dv, which is either the precharge pixel value or the compensation pixel value. Then, the source driver 1070 thereby outputs driving voltage Vd to drive the LCD.

The LCD driving apparatus 1000 receives the pixel value D, saves the pixel value D in the frame memory 1010. Then, the calculation&expand unit 1030 outputs a compensation pixel value and a precharge pixel value according to the pixel value D and the overdrive compensation value from the overdrive compensation unit 1020. The precharge pixel value and the compensation pixel value are saved to the frame memory 1010 to be used later by the overdrive compensation unit 1020 and by the calculation&expand unit 1030 to output to the multiplexer 1060. The overdrive compensation unit 1020 outputs the overdrive compensation value according to the pixel value D, the precharge pixel value, the compensation pixel value, or the temperature value outputted by the temperature sensor 1023. The temperature sensor 1023 is not the necessary element in this embodiment, but can enhance the performance of the overdrive compensation unit 1020.

The field controller 1050 controls the multiplexer 1060 to output the precharge pixel value or the compensation pixel value according to the second synchronization signal derived from the first synchronization signal Fsync.

Figure 14:
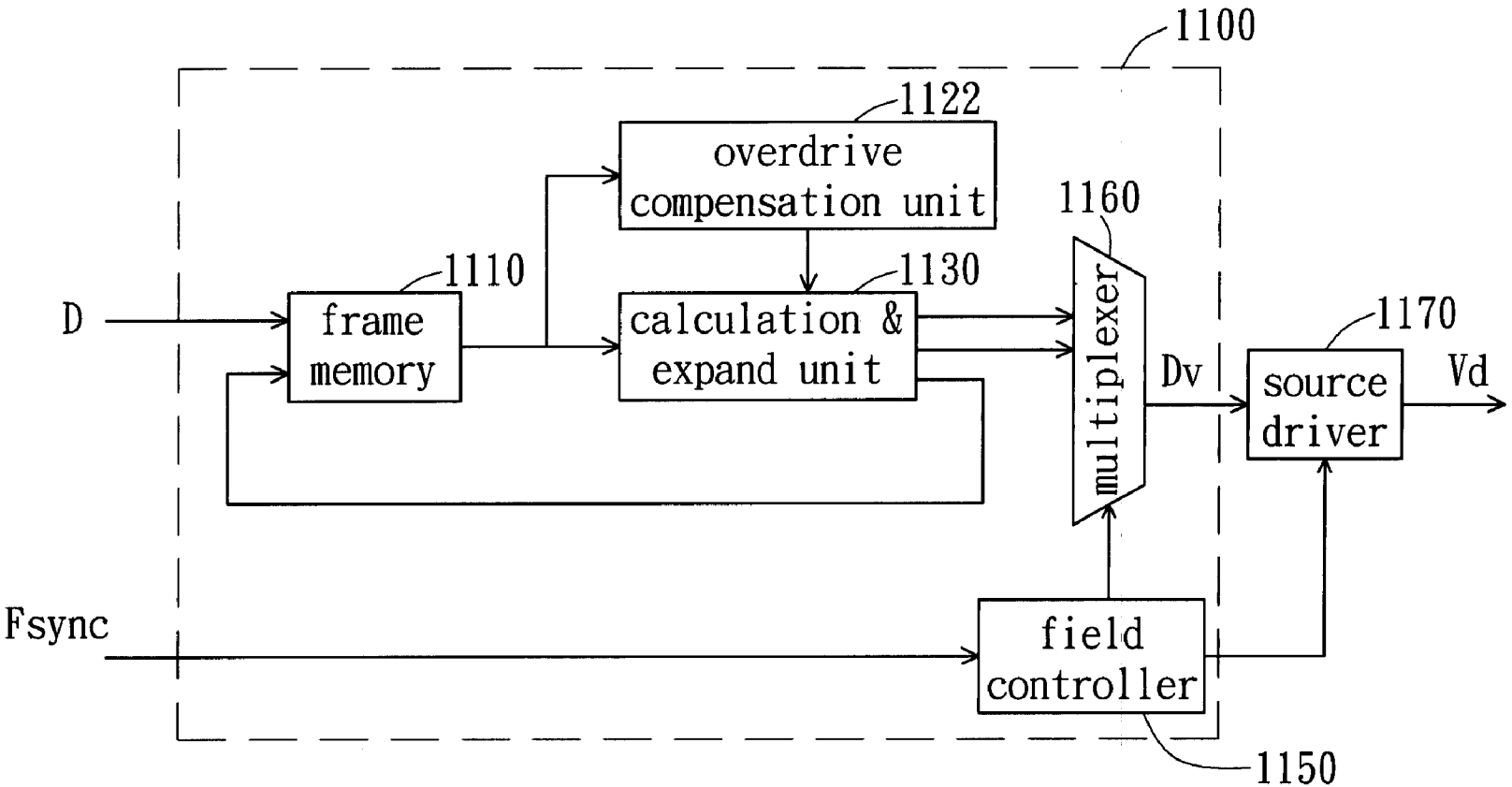
FIG. 14 shows the block diagram of an LCD driving apparatus according to a ninth embodiment of the present invention.

Referring to FIG. 14, it shows the block diagram of an LCD driving apparatus according to a ninth embodiment of the present invention. The driving apparatus 1100 includes a frame memory 1110, a mathematic unit, and a field controller 1150. The mathematic unit includes a overdrive compensation unit 1122, a calculation&expand unit 1130, and a multiplexer 1160. The LCD driving apparatus 1100 receives a pixel value D and outputs driving value Dv, which is either the precharge pixel value or the compensation pixel value. Then, the source driver 1170 thereby outputs driving voltage Vd to drive the LCD.

The LCD driving apparatus 1100 receives the pixel value D, saves the pixel value D in the frame memory 1110. Then, the calculation&expand unit 1130 outputs a compensation pixel value and a precharge pixel value according to the pixel value D and the overdrive compensation value from the overdrive compensation unit 1122. The precharge pixel value and the compensation pixel value are saved to the frame memory 1110 to be used later by the overdrive compensation unit 1122 and by the calculation&expand unit 1130 to output to the multiplexer 1160. The field controller 1150 controls the multiplexer 1160 to output the precharge pixel value or the compensation pixel value according to the second synchronization signal derived from the first synchronization signal Fsync.

Figure 15:
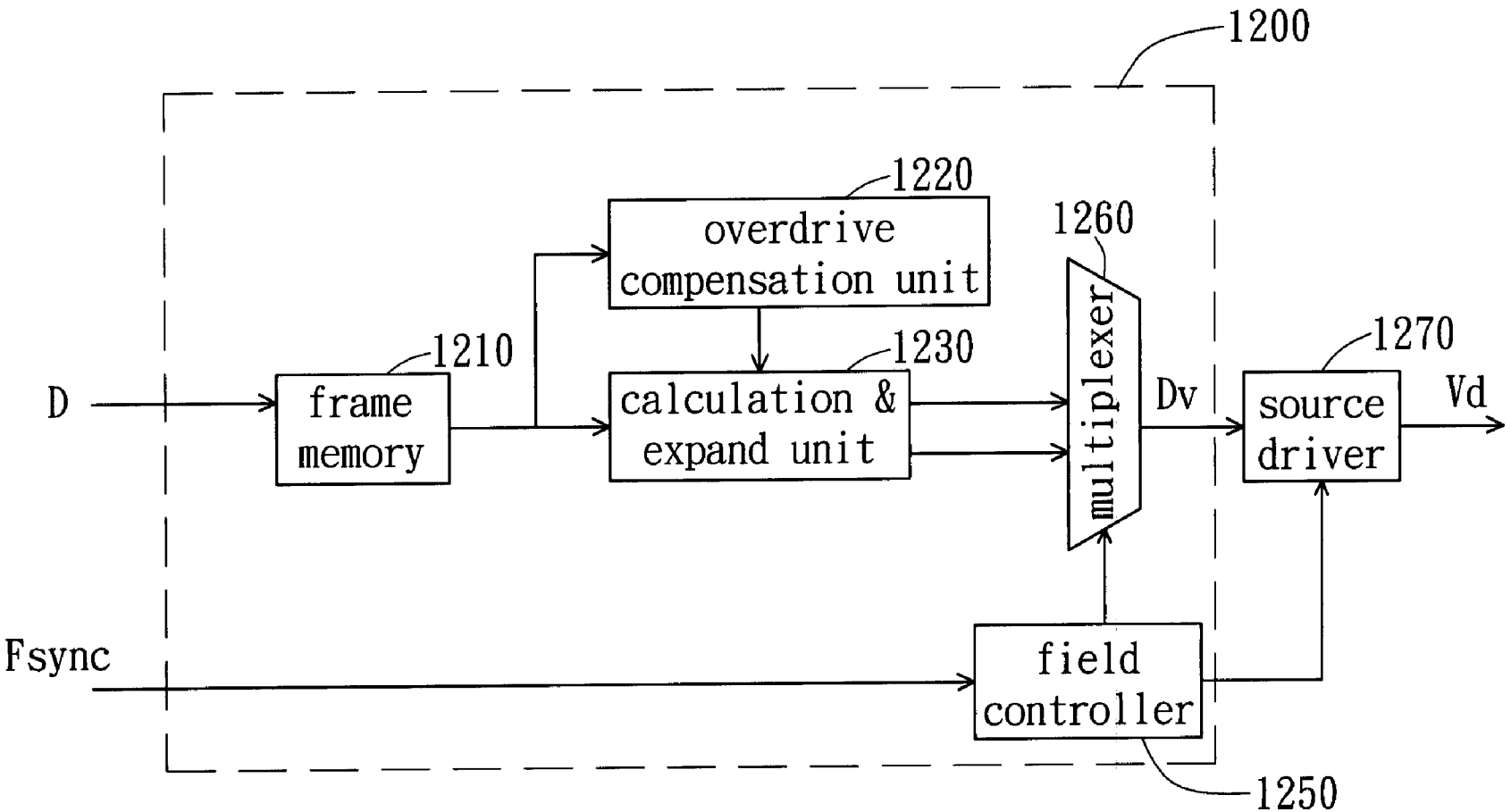
FIG. 15 shows the block diagram of an LCD driving apparatus according to a tenth embodiment of the present invention.

Referring to FIG. 15, it shows the block diagram of an LCD driving apparatus according to a tenth embodiment of the present invention. The driving apparatus 1200 includes a frame memory 1210, a mathematic unit, and a field controller 1250. The mathematic unit includes a overdrive compensation unit 1220, a calculation&expand unit 1230, and a multiplexer 1260. The LCD driving apparatus 1200 receives a pixel value D and outputs driving value Dv, which is either the precharge pixel value or the compensation pixel value. Then, the source driver 1270 thereby outputs driving voltage Vd to drive the LCD.

The LCD driving apparatus 1200 receives the pixel value D, saves the pixel value D in the frame memory 1210. Then, the calculation&expand unit 1230 outputs a compensation pixel value and a precharge pixel value according to the pixel value D and the overdrive compensation value from the overdrive compensation unit 1220. The field controller 1250 controls the multiplexer 1260 to output the precharge pixel value or the compensation pixel value according to the second synchronization signal derived from the first synchronization signal Fsync.

Figure 16A:
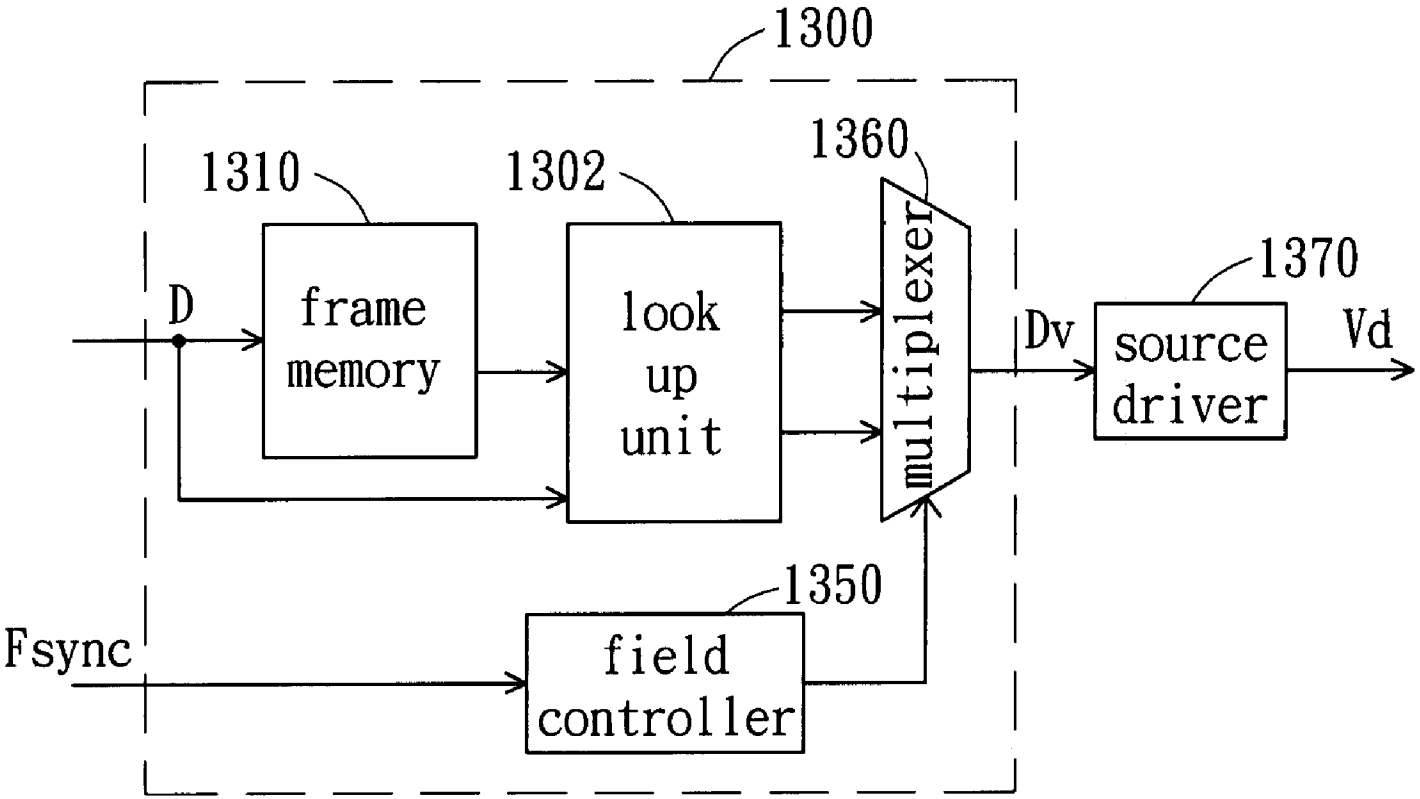
FIG. 16A shows the block diagram of an LCD driving apparatus according to an eleventh embodiment of the present invention.

Referring to FIG. 16A, it shows the block diagram of an LCD driving apparatus according to an eleventh embodiment of the present invention. The driving apparatus 1300 includes a frame memory 1310, a mathematic unit, and a field controller 1350. The mathematic unit includes a look up unit 1302 and a multiplexer 1360. The LCD driving apparatus 1300 receives a pixel value D and outputs driving value Dv, which is either the precharge pixel value or the compensation pixel value. Then, the source driver 1370 thereby outputs driving voltage Vd to drive the LCD. The pixel value D can be saved in the frame memory 1310 to be used by the look up unit 1302 later.

FIG. 16B shows the table used by the look up unit. The look up unit 1302 finds the corresponding precharge pixel value and compensation value in this table according to the pixel value. When the pixel value is 4, the precharge pixel value and the compensation pixel value are looked up to be 0 and 9 respectively such that the lightness of the frame period equals to the lightness if driven by the pixel value. The input and the outputted lightness of an LCD is not necessarily linear, and the content of the table can be adjusted according to the characteristics of the LCD.

While the invention has been described by way of example and in terms of the preferred embodiment, it is to be understood that the invention is not limited to the disclosed embodiment. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A circuit for driving a liquid crystal display (LCD), the circuit being adapted to receive a pixel value and drive a pixel of the LCD according to the pixel value during a frame period, the frame period being divided into a precharge field and a compensation field, the circuit comprising:

a driving apparatus comprising a field controller for receiving a first synchronization signal and thereby outputting a second synchronization signal, and a mathematic unit for receiving the pixel value and determining a precharge pixel value and a compensation pixel value, and for selectively outputting one of the precharge pixel value and the compensation pixel value according to the second synchronization signal;

a source driver for generating a precharge driving voltage and a compensation driving voltage according to the precharge pixel value and the compensation pixel value, respectively, so as to drive the pixel by the precharge driving voltage during the precharge field and to drive the pixel by the compensation driving voltage during the compensation field; and a frame memory for storing the pixel value and a threshold unit configured to receive the pixel value and compare the pixel value with a reference value, wherein a threshold value from the threshold unit is designated a first value to be saved in the frame memory when the pixel value is larger than the reference value, and the threshold value is designated a second value to be saved in the frame memory when the pixel value is smaller than or equal to the reference value.

2. The circuit according to claim 1, wherein the mathematic unit comprises:

a calculation unit for receiving the pixel value from the frame memory and the threshold value from the frame memory and outputting the compensation pixel value according to the pixel value and the threshold value;

an expand unit for receiving the threshold value and outputting the precharge pixel value according to the threshold value; and a multiplexer for selectively outputting either the precharge pixel value or the compensation pixel value.

3. The circuit according to claim 1, wherein the field controller is configured to control the sequence of the precharge field and the compensation field.

4. A circuit for driving a liquid crystal display (LCD), the circuit being adapted to receive a pixel value and drive a pixel of the LCD according to the pixel value during a frame period, the frame period being divided into a precharge field and a compensation field, the circuit comprising:

a driving apparatus comprising a field controller for receiving a first synchronization signal and thereby outputting a second synchronization signal, and a mathematic unit for receiving the pixel value and determining a precharge pixel value and a compensation pixel value, and for selectively outputting one of the precharge pixel value and the compensation pixel value according to the second synchronization signal; and a source driver for generating a precharge driving voltage and a compensation driving voltage according to the precharge pixel value and the compensation pixel value, respectively, so as to drive the pixel by the precharge driving voltage during the precharge field and to drive the pixel by the compensation driving voltage during the compensation field;

a frame memory for storing the pixel value and a threshold unit configured to receive the pixel value and compare the pixel value with a reference value, wherein a threshold value from the threshold unit is designated a first value to be saved in the frame memory when the pixel value is larger than the reference value, and the threshold value is designated a second value to be saved in the frame memory when the pixel value is smaller than or equal to the reference value;

wherein the mathematic unit comprises:

a calculation unit for receiving the pixel value from the frame memory and the threshold value from the frame memory and outputting the compensation pixel value according to the pixel value and the threshold value;

an expand unit for receiving the threshold value and outputting the precharge pixel value according to the threshold value; and a multiplexer for selectively outputting either the precharge pixel value or the compensation pixel value according to the second synchronization signal derived from the first synchronization signal.

5. The circuit according to claim 4, wherein the field controller is configured to control the sequence of the precharge field and the compensation field.

* * * * *